US011718974B2

(12) United States Patent
Gundupalli et al.

(10) Patent No.: US 11,718,974 B2
(45) Date of Patent: Aug. 8, 2023

(54) MOTOR GRADERS INCORPORATING MOUNT KITS FOR WORK IMPLEMENT ASSEMBLIES AND METHODS OF SERVICING MOTOR GRADERS

(71) Applicant: DEERE & COMPANY, Moline, IL (US)

(72) Inventors: John Gundupalli, Samalkot (IN); Basuraj Hippargi, Pune (IN)

(73) Assignee: DEERE & COMPANY, Moline, IL (US)

( * ) Notice: Subject to any disclaimer, the term of this patent is extended or adjusted under 35 U.S.C. 154(b) by 828 days.

(21) Appl. No.: 16/717,628

(22) Filed: Dec. 17, 2019

(65) Prior Publication Data

US 2021/0180289 A1 Jun. 17, 2021

(51) Int. Cl.
*E02F 3/76* (2006.01)
*E02F 3/815* (2006.01)

(52) U.S. Cl.
CPC ..... *E02F 3/8157* (2013.01); *E02F 3/764* (2013.01)

(58) Field of Classification Search
CPC ..... E02F 3/8157; E02F 3/764; E02F 3/7636
See application file for complete search history.

(56) References Cited

U.S. PATENT DOCUMENTS 7,650,949 B1 * 1/2010 Horstman ..... E02F 3/7677 172/795
9,540,787 B2 * 1/2017 West ..... E02F 3/7668
11,453,996 B2 * 9/2022 Kovalick ..... E02F 3/80
2010/0051301 A1 * 3/2010 Staade ..... E02F 3/7681 172/776
2012/0073890 A1 * 3/2012 Bindl ..... E02F 3/764 180/374
2015/0129265 A1 * 5/2015 Vahling ..... E02F 3/764 172/701.3
2015/0135866 A1 * 5/2015 Staade ..... E02F 3/764 74/89.18
2021/0062908 A1 * 3/2021 Harshman ..... F16H 57/031
2021/0180289 A1 * 6/2021 Gundupalli ..... E02F 3/764
2021/0332551 A1 * 10/2021 Yamaguchi ..... F16N 1/00
2021/0355653 A1 * 11/2021 Reang ..... E02F 3/764
2021/0372080 A1 * 12/2021 Reang ..... E02F 3/764
2022/0195692 A1 * 6/2022 Deshpande ..... E02F 3/764

OTHER PUBLICATIONS

IP.Com Publication: Prior Art Database Technical Disclosure "Method of mounting circle frame to the draft frame of a motor grader"; Publication Date: Jun. 14, 2019.

* cited by examiner

*Primary Examiner* — Jamie L McGowan
(74) *Attorney, Agent, or Firm* — Taft Stettinius & Hollister LLP; Stephen F. Rost

(57) ABSTRACT

A grader includes a chassis and a work implement assembly. The work implement assembly has a draft frame pivotally coupled to the chassis, a circle frame coupled to the draft frame for rotation relative thereto to adjust an angular orientation of a moldboard supported by the circle frame, and a mount kit to pivotally retain the circle frame to the draft frame. The draft frame includes a platform having a first side that faces the moldboard, a second side arranged opposite the first side that faces away from the moldboard, and an opening extending through the first and second sides. The circle frame is arranged in confronting relation to the first side of the platform.

20 Claims, 5 Drawing Sheets

MOTOR GRADERS INCORPORATING MOUNT KITS FOR WORK IMPLEMENT ASSEMBLIES AND METHODS OF SERVICING MOTOR GRADERS

FIELD OF THE DISCLOSURE

The present disclosure relates, generally, to construction machines, and, more specifically, to graders.

BACKGROUND

Graders such as motor graders may include a chassis, a draft frame pivotally coupled to the chassis, and a circle frame pivotally coupled to the draft frame. One or more systems and/or devices may be employed to pivotally retain the circle frame to the draft frame. In some cases, servicing and/or maintenance of the system(s) and/or device(s) may present a variety of complications. Accordingly, configurations that avoid the shortcomings of those systems(s) and/or device(s) remain an area of interest.

SUMMARY

The present disclosure may comprise one or more of the following features and combinations thereof.

According to one aspect of the present disclosure, a grader may include a chassis and a work implement assembly. The work implement assembly may include a draft frame pivotally coupled to the chassis, a circle frame coupled to the draft frame for rotation relative thereto to adjust an angular orientation of a moldboard supported by the circle frame, and a mount kit to pivotally retain the circle frame to the draft frame. The draft frame may include a platform having a first side that faces the moldboard, a second side arranged opposite the first side that faces away from the moldboard, and an opening extending through the first and second sides. The circle frame may be arranged in confronting relation to the first side of the platform. The mount kit may include a plurality of retainer assemblies at least partially positioned in the opening that are accessible from the second side of the platform.

In some embodiments, the draft frame may include a ring extending outwardly away from the second side of the platform and around the opening, and each of the plurality of retainer assemblies may be coupled to an inner surface of the ring for movement relative thereto along the inner surface during rotation of the circle frame relative to the draft frame. Each of the plurality of retainer assemblies may include a retainer case and a wear pad arranged between the retainer case and the inner surface of the ring to minimize direct contact between the inner surface and the retainer case during movement of the retainer case relative to the ring along the inner surface. Each of the plurality of retainer assemblies may include a bracket arranged in contact with the circle frame, a plurality of fasteners that each extend through the bracket and are arranged in contact with the retainer case, and a plurality of adjustment nuts that each receive a corresponding one of the plurality of fasteners, and the plurality of adjustment nuts may be movable along the plurality of fasteners to adjust the position of the retainer case relative to the inner surface of the ring and to facilitate access to the wear pad from the second side of the platform.

In some embodiments, the draft frame may include a ring extending outwardly away from the second side of the platform and around the opening, each of the plurality of retainer assemblies may include a retainer case that is coupled to an inner surface of the ring for movement relative thereto along the inner surface during rotation of the circle frame relative to the draft frame, and each of the plurality of retainer assemblies may include a plurality of fasteners that extend through the retainer case and into the circle frame and are accessible from the second side of the platform. The plurality of fasteners of each of the plurality of retainer assemblies may include three fasteners. The plurality of retainer assemblies may include four retainer assemblies.

In some embodiments, the draft frame may include a ring extending outwardly away from the second side of the platform and around the opening, each of the plurality of retainer assemblies may include a retainer case that is arranged in contact with the circle frame and coupled to an inner surface of the ring for movement relative thereto along the inner surface during rotation of the circle frame relative to the draft frame, and each of the plurality of retainer assemblies may include a first wear pad arranged between the retainer case and the second side of the platform to minimize direct contact between the retainer case and the draft frame during movement of the retainer case relative to the ring along the inner surface. Each of the plurality of retainer assemblies may include a second wear pad arranged between the first side of the platform and the circle frame to minimize direct contact between the draft frame and the circle frame during rotation of the circle frame relative to the draft frame. The first wear pads of the plurality of retainer assemblies may be accessible from the second side of the platform and the second wear pads of the plurality of retainer assemblies may be accessible from an outer periphery of the draft frame and the circle frame.

According to another aspect of the present disclosure, a mount kit for a grader having a chassis, a draft frame coupled to the chassis, and a circle frame coupled to the draft frame for rotation relative thereto may include a plurality of retainer assemblies. The plurality of retainer assemblies may each be configured to be at least partially positioned in an opening that extends through a first side of a platform of the draft frame that faces a moldboard of the grader and is arranged in confronting relation to the circle frame and through a second side of the platform that is arranged opposite the first side and faces away from the moldboard. The plurality of retainer assemblies may be configured to pivotally retain the circle frame to the draft frame in use of the mount kit, and the plurality of retainer assemblies may be accessible from the second side of the platform of the draft frame for maintenance and/or servicing when the circle frame is pivotally retained to the draft frame in use of the mount kit.

In some embodiments, each of the plurality of retainer assemblies may include a retainer case having a first block configured for interaction with the second side of the platform of the draft frame and a second block interconnected with the first block that is configured for direct interaction with the circle frame, and the first block and the second block of each retainer case may be accessible from the second side of the platform of the draft frame in use of the mount kit. The second block of the retainer case of each of the plurality of retainer assemblies may include a plurality of columns and a plurality of cutouts each positioned between adjacent columns of the plurality of columns. The plurality of columns of the second block of each retainer case may include three columns, and the plurality of cutouts of the second block of each retainer case may include two cutouts.

In some embodiments, each of the plurality of cutouts of the second block of each retainer case may be cooperatively defined at least in part by a first exterior surface of a first column, a second exterior surface of a second column that faces the first exterior surface of the first column, a rib exterior surface of a rib of the second block that interconnects the first and second exterior surfaces, and a base of the second block that is interconnected with the first column, the second column, and the rib. The base of the second block of each retainer case may be configured to contact the circle frame in use of the mount kit, the plurality of columns of the second block of each retainer case may extend outwardly away from the corresponding base over a first distance, and an outer surface of the first block of each retainer case may be spaced a second distance greater than the first distance from the corresponding base. Additionally, in some embodiments, the mount kit may include a plurality of fasteners each sized to be received by a corresponding one of the plurality of columns of the second block of each retainer case such that each fastener extends all the way through the corresponding column and into the circle frame in use of the mount kit.

According to yet another aspect of the present disclosure, a method of servicing a grader including a chassis, a draft frame coupled to the chassis, a circle frame coupled to the draft frame for rotation relative thereto, and a mount kit to pivotally retain the circle frame to the draft frame may include accessing, from one side of a platform of the draft frame that faces away from a moldboard of the grader, a plurality of retainer assemblies of the mount kit that are at least partially positioned in an opening of the platform that extends through the one side of the platform and through another side of the platform arranged opposite the one side, and at least partially disassembling one or more of the plurality of retainer assemblies.

In some embodiments, at least partially disassembling one or more of the plurality of retainer assemblies includes adjusting a position of a retainer case of at least one of the plurality of retainer assemblies relative to a ring extending outwardly away from the one side of the platform to access a first wear pad arranged between the retainer case and the ring. At least partially disassembling one or more of the plurality of retainer assemblies may include accessing a second wear pad arranged between the retainer case of the at least one of the plurality of retainer assemblies and the draft frame and a third wear pad arranged between the second side of the platform and the circle frame.

These and other features of the present disclosure will become more apparent from the following description of the illustrative embodiments.

BRIEF DESCRIPTION OF THE DRAWINGS

The invention described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

Figure 1:
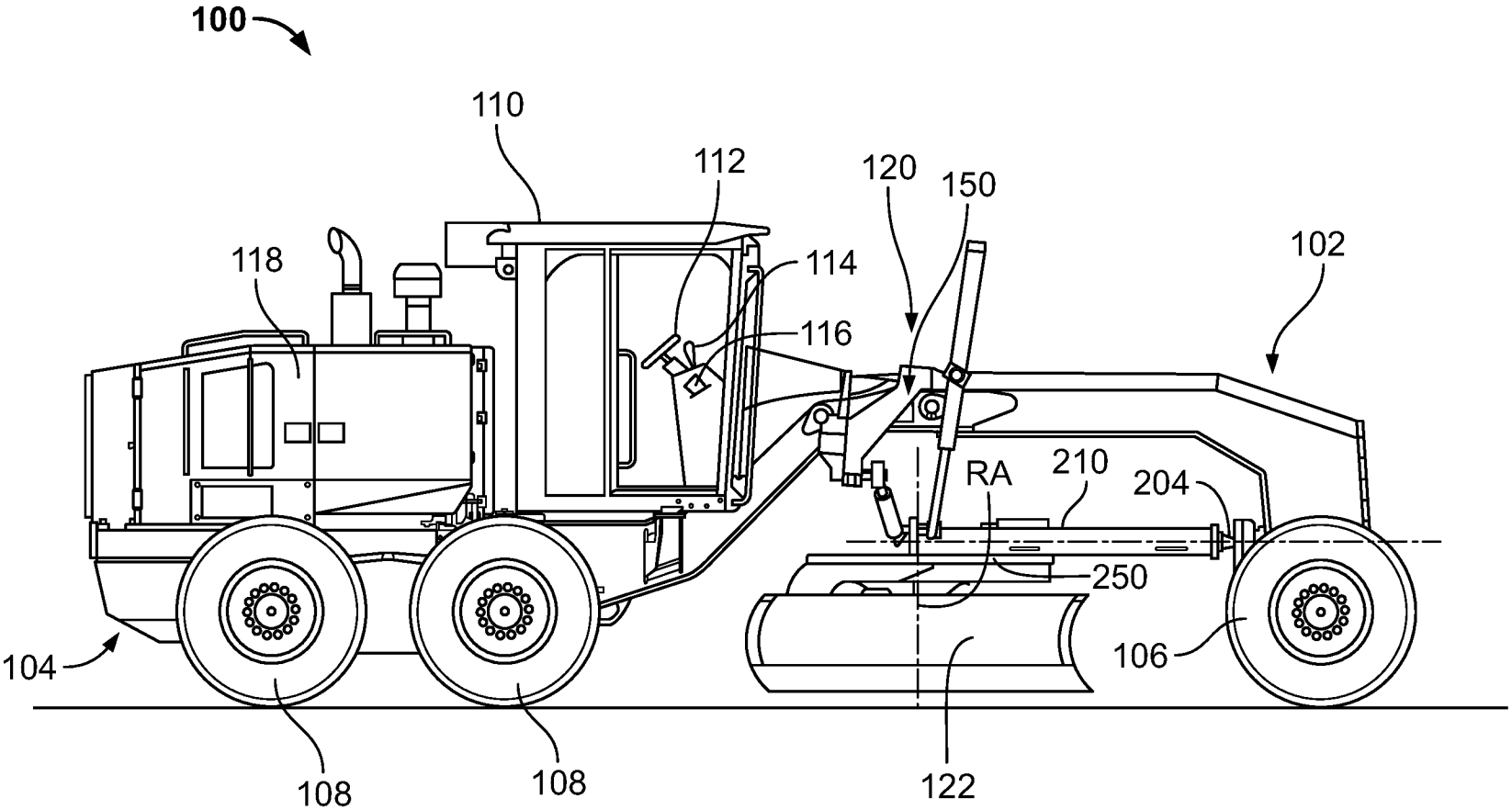
FIG. 1 is a side view of a motor grader.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

A number of features described below may be illustrated in the drawings in phantom. Depiction of certain features in phantom is intended to convey that those features may be hidden or present in one or more embodiments, while not necessarily present in other embodiments. Additionally, in the one or more embodiments in which those features may be present, illustration of the features in phantom is intended to convey that the features may have location(s) and/or position(s) different from the locations(s) and/or position(s) shown.

Referring now to FIG. 1, a construction machine 100 is illustratively embodied as, or otherwise includes, a motor grader. The motor grader 100 includes a front chassis or front frame 102 and a rear chassis or rear frame 104 arranged opposite the front chassis 102 and coupled thereto. The front chassis 102 is supported on a pair of front wheels 106 and the rear chassis is supported on tandem sets of rear wheels 108. The front chassis 102 supports an operator cab 110 in which various operational controls for the motor grader 100 are provided. Among other things, those controls may include a steering wheel 112, a lever assembly 114, and a dashboard 116.

In the illustrative embodiment, a drive unit or engine 118 mounted to the rear chassis 104 supplies driving power to all driven components of the motor grader 100. The drive unit 118 is embodied as, or otherwise includes, any device capable of supplying rotational power to driven components of the motor grader 100 to drive those components. In some embodiments, rotational power supplied by the drive unit 118 may be provided to the driven components of the grader 100 by one or more transmission(s). In one example, the drive unit 118 may be configured to supply power to a transmission that is coupled to the rear wheels 108 and operable to provide various predetermined speed ratios selectable by an operator in either reverse or forward operating modes. In another example, the drive unit 118 may be configured to supply power to a transmission that is coupled to the front wheels 106, such as a hydrostatic front-wheel-assist transmission, for example. Additionally, in some embodiments, the drive unit 118 may be coupled to a pump or generator to provide hydraulic, pneumatic, or electrical power to one or more components of the motor grader 100, as the case may be.

The illustrative motor grader 100 includes a work implement assembly 120 that is movably coupled to the front chassis 102. The work implement assembly 120 includes a moldboard or blade 122 that is configured to grade an underlying surface in use of the grader 100. Of course, it should be appreciated that another suitable device may be employed for that purpose. The illustrative work implement assembly 120 also includes a draft frame 210 (see FIG. 2), a circle frame 250, and a mount kit 260 to retain the circle frame 250 to the draft frame 210, as described in greater detail below. During operation of the motor grader 100, at least in some embodiments, it should be appreciated that multiple components of the work implement assembly 120 (e.g., the draft frame 210 and the circle frame 250) may be adjustable and/or repositionable to cooperatively alter an orientation of the moldboard 122 via a saddle linkage 150 of the motor grader 100.

Figure 2:
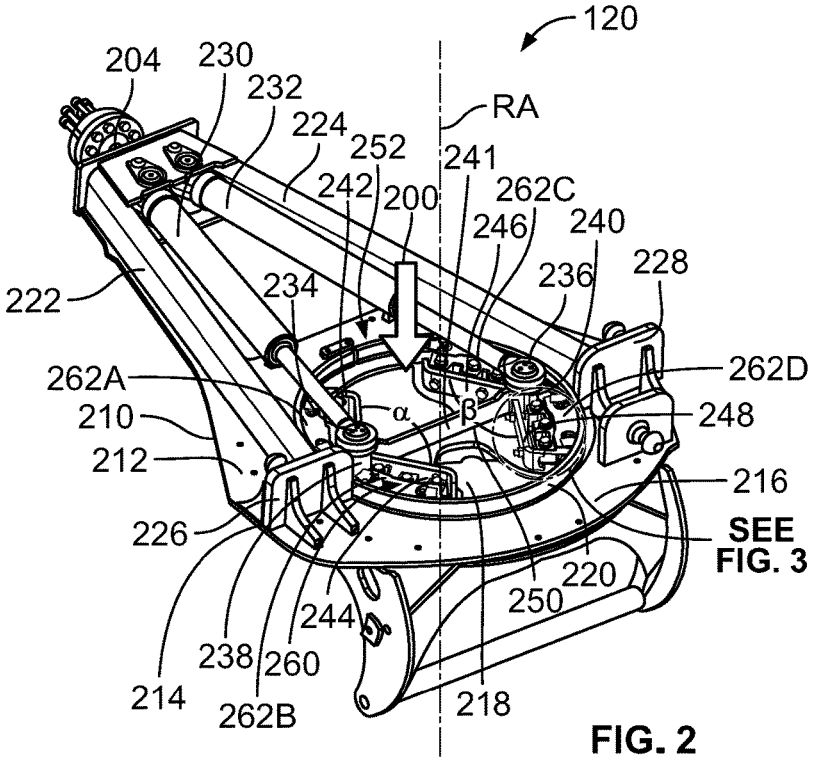
FIG. 2 is a perspective view of a work implement assembly of the motor grader of FIG. 1.

Referring now to FIG. 2, the illustrative draft frame 210 is pivotally coupled to the front chassis 102 via a ball and socket coupling 204. The circle frame 250 is illustratively coupled to the draft frame 210 for rotation relative thereto about a rotation axis RA to adjust an angular orientation of the moldboard 122 (which is omitted from FIG. 2 for the sake of simplicity) supported by the circle frame 250. The mount kit 260 pivotally retains the circle frame 250 to the draft frame 210. The draft frame 210 includes a platform 212 having a side 214 (which may be referred to as a bottom or lower side) that faces the moldboard 122, a side 216 (which may be referred to as a top or upper side) arranged opposite the side 214 that faces away from the moldboard 122, and an opening or passage 218 that extends through the sides 214, 216. The circle frame 250 is arranged in confronting relation to the side 214. In the illustrative embodiment, the mount kit 260 includes retainer assemblies 262A, 262B, 262C, 262D that are at least partially positioned in the opening 218 and accessible from the side 216 of the platform 212 of the draft frame 210.

In one respect, the illustrative configuration of the work implement assembly 120 may facilitate a greater degree of rotation of the circle frame 250 relative to the draft frame 210 about the rotation axis RA compared to the rotation permitted by other configurations. For example, in the illustrative configuration, the circle frame 250 may achieve approximately 30 degrees of additional rotation about the rotation axis RA in multiple directions (e.g., a clockwise direction and a counterclockwise direction) compared to other configurations. In another respect, location of the mount kit 260 inside a ring 220 of the draft frame 210 in the illustrative configuration of the work implement assembly 120 may provide greater visibility of the mount kit 260 and/or the circle frame 250 than might otherwise be achieved in other locations of the mount kit 260 (e.g., outside of the ring 220 and/or below the side 216 of the draft frame 210). In yet another respect, due to the location of the mount kit 260 in the illustrative configuration, the work implement assembly 120 may be particularly well suited for applications in which rotation of the circle frame 250 about the rotation axis RA is driven by a motor, gearbox, and/or transmission positioned outside of the ring 220. Finally, in yet another respect still, the location of the mount kit 260 in the illustrative configuration of the work implement assembly 120 may facilitate installation, maintenance, and/or servicing of the mount kit 260 compared to other configurations (e.g., configurations in which serviceable components used to couple the circle frame 250 to the draft frame 210 are substantially inaccessible from the side 216 of the draft frame 210).

The illustrative draft frame 210 includes beams 222, 224 that cooperate to define a V-shaped structure of the draft frame 210. The beams 222, 224 are coupled to the side 216 of the platform 212 via respective mounting brackets 226, 228. The mounting brackets 226, 228 are arranged on the side 216 of the platform 212 outside of the ring 220 and opposite one another. As such, the ring 220, which extends outwardly away from the side 216 of the platform 212 and around the opening 218, is arranged substantially between the mounting brackets 226, 228. The retainer assemblies 262A, 262B, 262C, 262D of the mount kit 260 are arranged inside the ring 220 between the brackets 226, 228 such that the retainer assemblies 262A, 262B, 262C, 262D are accessible from the side 216.

In the illustrative embodiment, rotation of the circle frame 250 about the rotation axis RA relative to the draft frame 210 is driven by a pair of cylinders 230, 232. Each of the illustrative cylinders 230, 232 is embodied as, or otherwise includes, a hydraulic actuator such as a double-acting cylinder, for example. Of course, it should be appreciated that each of the cylinders 230, 232 may be embodied as, or otherwise include, another suitable actuator. In any case, each of the cylinders 230, 232 is extendable and retractable to adjust the length thereof and thereby drive movement of the circle frame 250 about the rotation axis RA relative to the draft frame 210.

The illustrative cylinders 230, 232 include, or are otherwise coupled to, respective posts 234, 236. The posts 234, 236 are coupled to the circle frame 250 and extend outwardly away from the circle frame 250 through the opening 218. The posts 234, 236 are encircled by respective sleeves 238, 240 that are interconnected by a central strut 241. Brackets 242, 244 are interconnected with the sleeve 238 and the circle frame 250 and brackets 246, 248 are interconnected with the sleeve 240 and the circle frame 250. The brackets 242, 244 cooperate to define an angle $\alpha$ therebetween and the brackets 246, 248 cooperate to define an angle $\beta$ therebetween that is substantially identical to the angle $\alpha$. In some embodiments, each of the angles $\alpha$, $\beta$ may be embodied as, or otherwise include, an obtuse angle. In any case, in the illustrative embodiment, the central strut 241 substantially bisects each of the angles α, β.

In some embodiments, the features 230, 232, 234, 236, 238, 240, 241, 242, 244, 246, 248 may be included in, or otherwise cooperate to define, a drive assembly 252 configured to drive rotation of the circle frame 250 relative to the draft frame 210 about the rotation axis RA. In such embodiments, at least some of the features (e.g., the brackets 242, 244, 246, 248) may be included in, or otherwise define a portion of, each retainer assembly 262A, 262B, 262C, 262D. Regardless, in the illustrative embodiment, the features 230, 232, 234, 236, 238, 240, 241, 242, 244, 246, 248 are at least partially accessible from the side 216 of the draft frame 210. Additionally, in the illustrative embodiment, the ring 220 extends around at least part of the posts 234, 236, the sleeves 238, 240, the strut 241, and the brackets 242, 244, 246, 248.

In the illustrative embodiment, the mount kit 260 includes four substantially identical retainer assemblies 262A, 262B, 262C, 262D each configured for rotation with the circle frame 250 about the rotation axis RA relative to the draft frame 210. In other embodiments, however, it should be appreciated that the mount kit 260 may include another suitable number of retainer assemblies to pivotally retain the circle frame 250 to the draft frame 210. The illustrative retainer assemblies 262A, 262B are coupled to respective brackets 242, 244. The illustrative retainer assemblies 262C, 262D are coupled to respective brackets 246, 248. In some embodiments, the retainer assemblies 262A, 262B may include the brackets 242, 244, respectively. Additionally, in some embodiments, the retainer assemblies 262C, 262D may include the brackets 246, 248, respectively.

The illustrative circle frame 250 is embodied as, or otherwise includes, a circular structure that is pivotally coupled to the draft frame 210 via the mount kit 260 to permit rotation relative thereto about the rotation axis RA. As discussed above, in some embodiments, rotation of the circle frame 250 may be driven by the drive assembly 252. In other embodiments, as described in greater detail below with reference to FIGS. 5 and 6, rotation of the circle frame 250 may be driven by a drive assembly 552.

Figure 3:
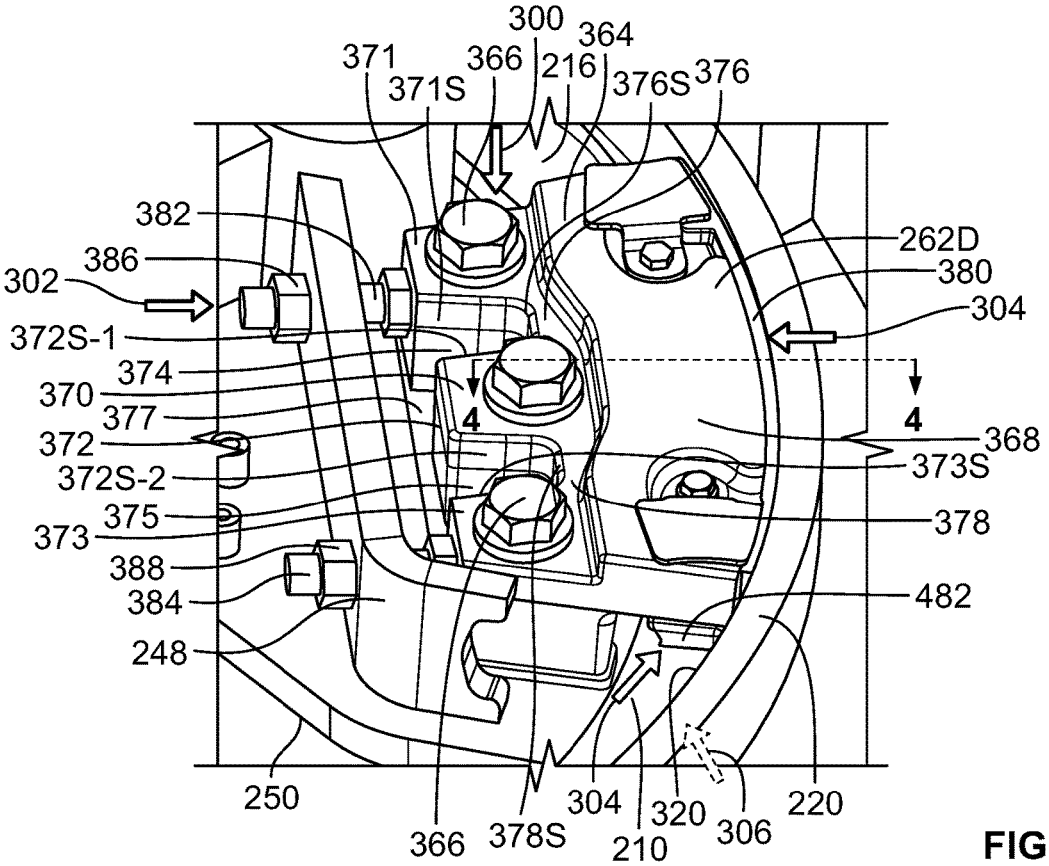
FIG. 3 is a detail view of a retainer assembly of a mount kit included in the work implement assembly of FIG. 2.

Referring now to FIG. 3, the illustrative retainer assembly 262D is coupled to an inner surface 320 of the ring 220 for movement relative thereto along the inner surface 320 during rotation of the circle frame 250 relative to the draft frame 210. It should be appreciated that each of the retainer assemblies 262A, 262B, 262C is coupled to the inner surface 320 for movement relative thereto in substantially identical fashion to the retainer assembly 262D. Accordingly, discussion of the coupling arrangement between the retainer assemblies 262A, 262B, 262C and the ring 220 is omitted for the sake of simplicity. Additionally, because the retainer assemblies 262A, 262B, 262C, 262D are substantially identical as indicated above, discussion of the components of only the retainer assembly 262D is provided below for the sake of brevity. Furthermore, it should be appreciated that interaction(s) between various components of the work implement assembly 120 (e.g., the draft frame 210 and the circle frame 250) and the retainer assemblies 262A, 262B, 262C is substantially identical to the interaction(s) between those components and the retainer assembly 262D described below.

The illustrative retainer assembly 262D includes a retainer case or housing 364 arranged in contact with the circle frame 250 and fasteners 366 that are received by, and extend through, the retainer case 364. The retainer case 364 is coupled to the inner surface 320 of the ring 220 for movement relative thereto along the inner surface 320 during rotation of the circle frame 250 relative to the draft frame 210. In the illustrative embodiment, the fasteners 366 include three fasteners. Of course, in other embodiments, the fasteners 366 may include another suitable number of fasteners. In any case, the retainer case 364 and the fasteners 366 are accessible from the side 216 of the draft frame 210.

In the illustrative embodiment, the retainer case 364 of the retainer assembly 262D includes a block 368 and a block 370 interconnected with the block 368. The block 368 is coupled to and configured for interaction with the side 216 of the draft frame 210 via a wear pad 482 (see FIG. 4). The block 370 is arranged in contact with, and configured for direct interaction with, the circle frame 250. As suggested above, each of the blocks 368 and 370 is accessible from the side 216 of the draft frame 210.

The illustrative block 370 of the retainer case 364 of the retainer assembly 262D includes columns 371, 372, 373 and cutouts 374, 375. The cutout 374 is positioned between the columns 371, 372 and the cutout 375 is positioned between the columns 372, 373. Thus, in the illustrative embodiment, the block 370 includes the three columns 371, 372, 373 and the two cutouts 374, 375. Of course, it should be appreciated that in other embodiments, the block 370 may include another suitable number of columns and another suitable number of cutouts.

The illustrative cutout 374 of the retainer assembly 262D is cooperatively defined at least in part by an exterior surface 371S of the column 371, an exterior surface 372S-1 of the column 372, an exterior surface 376S of a rib 376 of the block 370, and a base 377 of the block 370. The exterior surface 372S-1 of the column 372 faces the exterior surface 371S of the column 371. The rib 376 interconnects the columns 371, 372 such that the exterior surface 376S interconnects the exterior surfaces 371S, 372S-1. The base 377 interconnects the columns 371, 372 and the rib 376.

The illustrative cutout 375 of the retainer assembly 262D is cooperatively defined at least in part by an exterior surface 372S-2 of the column 372, an exterior surface 373S of the column 373, an exterior surface 378S of a rib 378 of the block 370, and the base 377 of the block 370. The exterior surface 372S-2 of the column 372 faces the exterior surface 373S of the column 373 and is arranged opposite the exterior surface 372S-1. The rib 378 interconnects the columns 372, 373 such that the exterior surface 378S interconnects the exterior surfaces 372S-2, 373S. The base 377 interconnects the columns 372, 373 and the rib 378.

Figure 4:
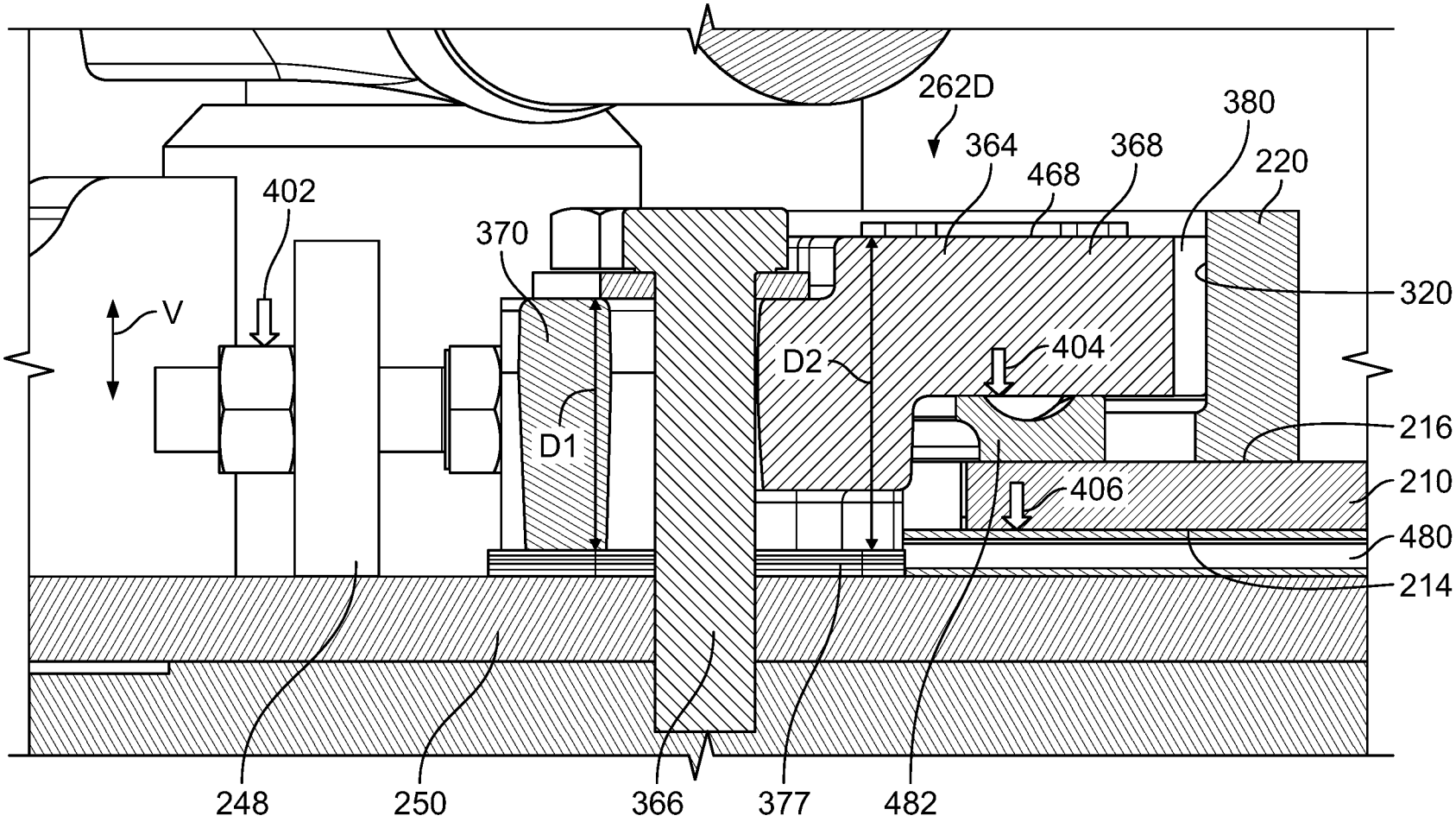
FIG. 4 is a partial sectional view of the retainer assembly of FIG. 3 taken about line 4-4.

In the illustrative embodiment, each of the fasteners 366 is sized to be received by a corresponding one of the columns 371, 372, 373 of the block 370 of the retainer assembly 262D. More specifically, as best seen in FIG. 4, each of the fasteners 366 is sized to be received by a corresponding one of the columns 371, 372, 373 of the block 370 such that each of the fasteners 366 extends all the way through the corresponding column 371, 372, 373 and the base 377 of the block 370. Thus, each of the fasteners 366 extends all the way through the block 370 in use of the illustrative mount kit 260.

As best seen in FIG. 3, the illustrative retainer assembly 262D includes a wear pad 380 arranged between the inner surface 320 of the ring 220 and the block 368 of the retainer case 364. In the illustrative embodiment, the wear pad 380 is configured to minimize direct contact between the inner surface 320 and the retainer case 364 during movement of the retainer case 364 relative to the ring 220 along the inner surface 320 (i.e., when the circle frame 250 rotates relative to the draft frame 210). As such, the wear pad 380 is embodied as, or otherwise includes, any device capable of minimizing degradation and/or wear that would otherwise result from direct contact between the inner surface 320 and the retainer case 364.

At least in some embodiments, the illustrative retainer assembly 262D includes the bracket 248 that is arranged in contact with the circle frame 250. Additionally, in such embodiments, the retainer assembly 262D includes fasteners 382, 384 that each extend through the bracket 248 and are arranged in contact with the block 370 of the retainer case 264. More specifically, the fastener 382 extends through the bracket 248 and is arranged in contact with the column 371 of the block 370, and the fastener 384 extends through the bracket 248 and is arranged in contact with the column 373 of the block 370.

In the illustrative embodiment, the retainer assembly 262D includes adjustment nuts 386, 388 that each receive a corresponding fastener 382, 384. The adjustment nuts 386, 388 are each movable along the respective fasteners 382, 384 to adjust the position of the retainer case 364 relative to the inner surface 320 of the ring 220 and to facilitate access to the wear pad 380 from the side 216 of the draft frame 210. Movement of the adjustment nuts 386, 388 along the respective fasteners 382, 384 toward the retainer case 364 increases the radially compressive force(s) applied to the wear pad 380 by the retainer case 364. Conversely, movement of the adjustment nuts 386, 388 along the respective fasteners 382, 384 away from the retainer case 364 decreases the radially compressive force(s) applied to the wear pad 380 by the retainer case 364.

Referring now to FIG. 4, in the illustrative configuration of the retainer assembly 262D, each of the fasteners 366 extends all the way through the block 370 of the retainer case 364 and into the circle frame 250 to couple the retainer case 364 to the circle frame 250. The base 377 of the block 370 is arranged in contact with the circle frame 250. The base 377 is arranged adjacent to a wear pad 480 of the retainer assembly 262D that is positioned between the draft frame 210 and the circle frame 250.

The illustrative wear pad 480 is arranged between the lower side 214 of the draft frame 210 and the circle frame 250. As such, for the purposes of the present disclosure, the wear pad 480 may be referred to as a lower wear pad 480. In any case, in the illustrative embodiment, the wear pad 480 is configured to minimize direct contact between the side 214 of the draft frame 210 and the circle frame 250 during rotation of the circle frame 250 relative to the draft frame 210. As such, the wear pad 480 is embodied as, or otherwise includes, any device capable of minimizing degradation and/or wear that would otherwise result from direct contact between the side 214 of the draft frame 210 and the circle frame 250.

In the illustrative configuration of the retainer assembly 262D, a wear pad 482 of the assembly 262D is arranged between the retainer case 364 and the upper side 216 of the draft frame 210. As such, for the purposes of the present disclosure, the wear pad 482 may be referred to as an upper wear pad 482. In any case, in the illustrative embodiment, the wear pad 482 is configured to minimize direct contact between the retainer case 364 and the side 216 of the draft frame 210 during movement of the retainer case 364 relative to the ring 220 along the inner surface 320 (i.e., when the circle frame 250 rotates relative to the draft frame 210). As such, the wear pad 482 is embodied as, or otherwise includes, any device capable of minimizing degradation and/or wear that would otherwise result from direct contact between the retainer case 364 and the side 216 of the draft frame 210.

In the illustrative embodiment, the wear pads 380, 480, 482 are accessible for maintenance and/or servicing from the side 216 of the draft frame 210. Of course, it should be appreciated that to access the wear pads 380, 480, 482, partial disassembly of the retainer assembly 262D from the side 216 of the draft frame 210 may be required. Such disassembly is described in greater detail below with reference to FIGS. 2-4.

Each of the illustrative columns 371, 372, 373 of the block 370 of the retainer case 364 extends outwardly away from the base 377 of the retainer case 364 over a distance D1. An uppermost exterior surface 468 of the block 368 of the retainer case 364 is spaced a distance D2 from the base 377 in a vertical direction indicated by arrow V. In the illustrative embodiment, the distance D2 is greater than the distance D1.

Referring now to FIGS. 2-4, a method of servicing the motor grader 100 may include, as indicated by arrow 200 (see FIG. 2), accessing one or more of the retainer assemblies 262A, 262B, 262C, 262D from the side 216 of the platform 212 of the draft frame 210. To do so, an operator or robot may insert one or more tools or instruments adapted for use with the retainer assemblies 262A, 262B, 262C, 262D toward the opening 218 surrounded by the ring 220 from the side 216 of the draft frame 210. It should be appreciated that in some embodiments, accessing one or more of the retainer assemblies 262A, 262B, 262C, 262D from the side 216 may include, or otherwise be attendant to, accessing one or more components of the drive assembly 252 from the side 216.

The method of servicing the motor grader 100 may include, as indicated by arrow 300 (see FIG. 3), at least partially disassembling one or more of the retainer assemblies 262A, 262B, 262C, 262D from the side 216 of the platform 212 of the draft frame 210. In some embodiments, at least partially disassembling one or more of the retainer assemblies 262A, 262B, 262C, 262D from the side 216 may include, or otherwise be attendant to, adjusting the position of one or more retainer cases (e.g., the case 364) relative to the ring 220 from the side 216 to access one or more wear pads (e.g., the wear pad 380) arranged between the one or more retainer cases and the ring 220. That adjustment is indicated by arrow 302. Additionally, in some embodiments, adjusting the position of the one or more retainer cases relative to the ring 220 from the side 216 to access the one or more wear pads may include, or otherwise be attendant to, moving one or more adjustment nuts (e.g., one or more of the nuts 386, 388) along one or more fasteners (e.g., one or more of the fasteners 382, 384) from the side 216. That movement is indicated by arrow 402 (see FIG. 4).

In some embodiments, at least partially disassembling one or more of the retainer assemblies 262A, 262B, 262C, 262D from the side 216 may include, or otherwise be attendant to, accessing one or more wear pads (e.g., the wear pad 482) arranged between one or more retainer cases (e.g., the retainer case 364) and the draft frame 210 from the side 216. That access is indicated by arrow 304. Additionally, in some embodiments, accessing the one or more wear pads arranged between the one or more retainer cases and the draft frame 210 from the side 216 may include, or otherwise be attendant to, de-coupling the one or more retainer cases from the circle frame 250 from the side 216 to expose the one or more wear pads. That de-coupling is indicated by arrow 404.

In some embodiments, at least partially disassembling one or more of the retainer assemblies 262A, 262B, 262C, 262D from the side 216 may include, or otherwise be attendant to, accessing one or more wear pads (e.g., the wear pad 480) arranged between the side 214 of the draft frame 210 and the circle frame 250 from the side 216. That access is indicated by arrow 306. Additionally, in some embodiments, accessing the one or more wear pads arranged between the side 214 of the draft frame 210 and the circle frame 250 from the side 216 may include, or otherwise be attendant to, de-coupling the one or more retainer cases from the circle frame 250 from the side 216 to facilitate exposure to the one or more wear pads. That de-coupling is indicated by arrow 406.

Figure 5:
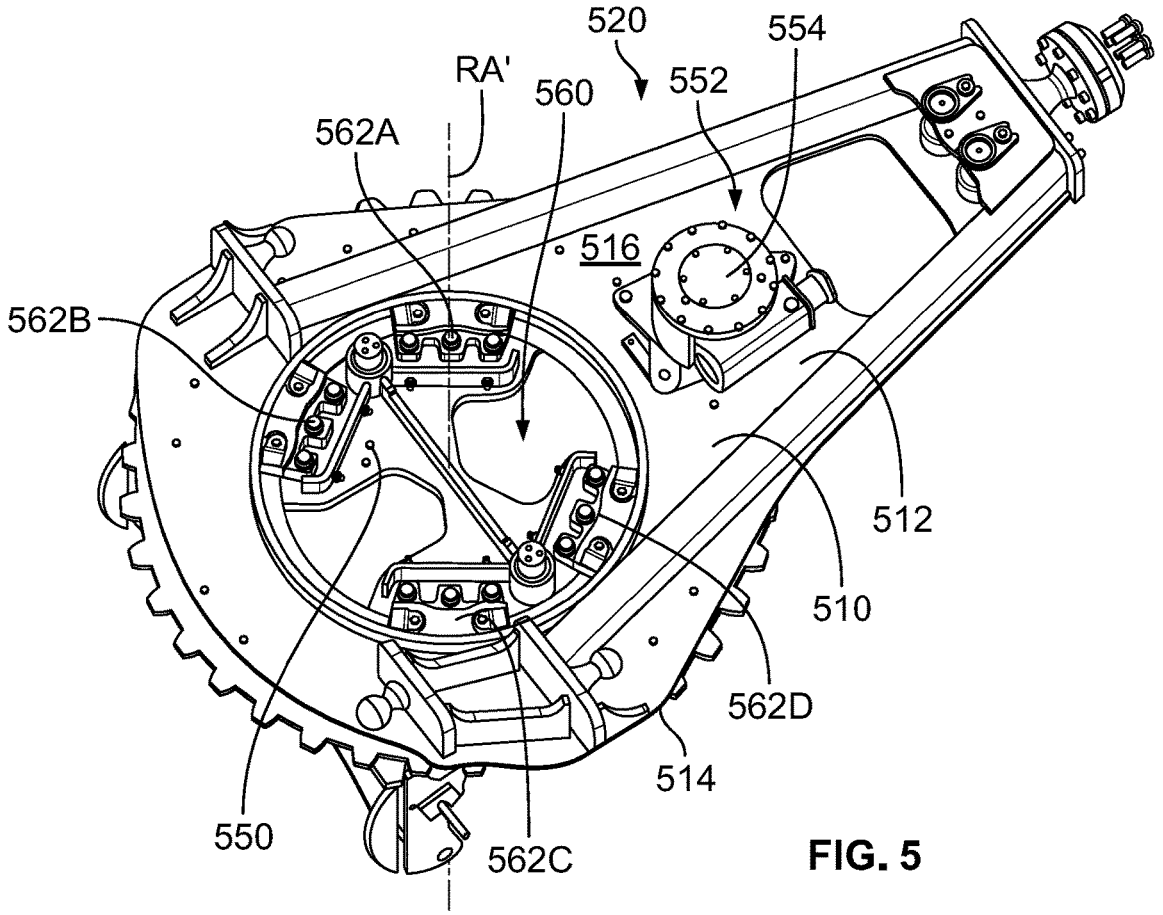
FIG. 5 is a perspective top view of another work implement assembly adapted for inclusion in the motor grader of FIG. 1.

Referring now to FIG. 5, an illustrative work implement assembly 520 is adapted for use in the motor grader 100. It should be appreciated that the work implement assembly 520 may be employed in the motor grader 100 in lieu of, and/or as a substitute for, the work implement assembly 120. In any case, the work implement assembly 520 includes a draft frame 510, a circle frame 550 pivotally coupled to the draft frame 510, and a mount kit 560 to pivotally retain the circle frame 550 to the draft frame 510. The draft frame 510 is substantially similar to the draft frame 210 and the mount kit 560 is substantially similar to the mount kit 260. As such, retainer assemblies 562A, 562B, 562C, 562D of the mount kit 560 are accessible from a side 516 of a platform 512 of the draft frame 510 that faces away from a moldboard (not shown) supported by the circle frame 550 and is arranged opposite a side 514 that faces the moldboard.

The work implement assembly 520 illustratively includes a drive assembly 552 that is configured to drive rotation of the circle frame 550 relative to the draft frame 510 about a rotation axis RA'. In the illustrative embodiment, the drive assembly 552 includes a drive unit 554 that is coupled to the side 516 of the platform 512 of the draft frame 510. The drive unit 554 may be embodied as, or otherwise include, any suitable device or collection of device(s) capable of driving rotation of the circle frame 550 about the rotation axis RA'. In some embodiments, the drive unit 554 may be embodied as, or otherwise include, one or more motors and/or one or more gearboxes.

Figure 6:
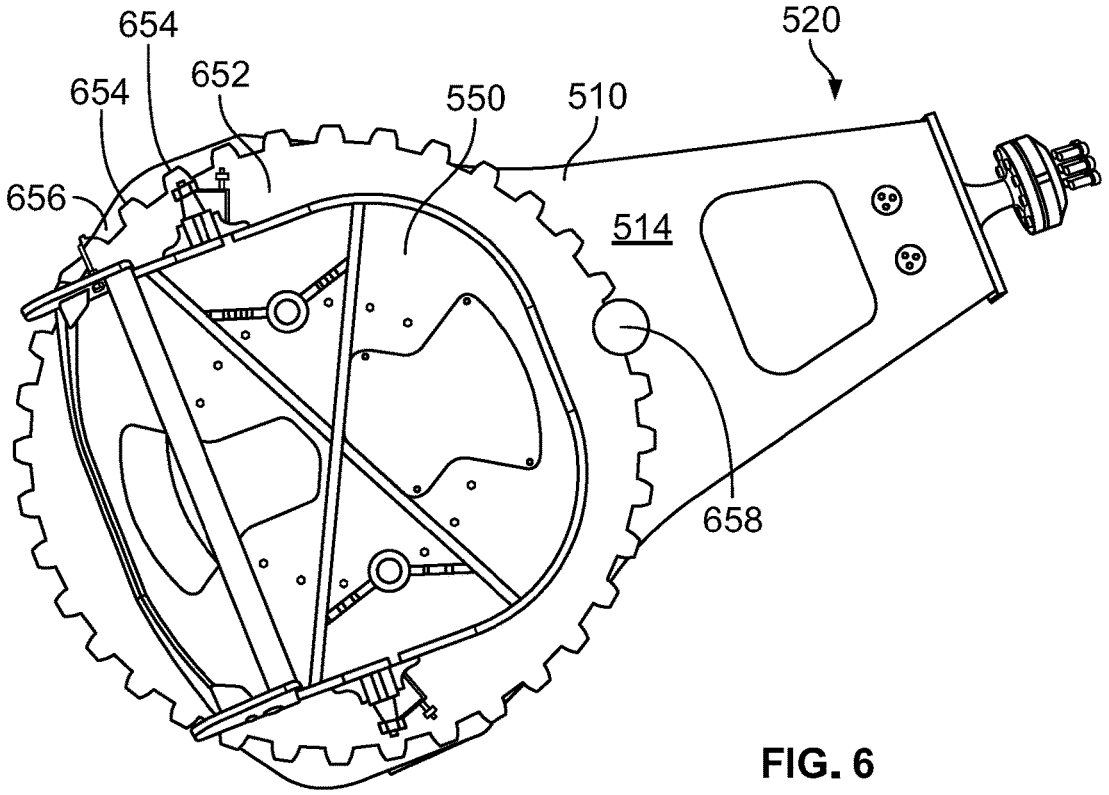
FIG. 6 is a perspective bottom view of the work implement assembly of FIG. 5.

Referring now to FIG. 6, the illustrative drive assembly 552 includes a disc 658 coupled to the drive unit 554 and configured to be driven for rotation by the drive unit 554. In the illustrative embodiment, the circle frame 550 is embodied as, or otherwise includes, a circular wheel 652 having teeth 654 circumferentially arranged at an outer perimeter thereof and notches 656 disposed between circumferentially adjacent teeth 654. The disc 658 is arranged in contact with the outer perimeter of the wheel 652 such that the disc 658 interacts with one or more of the teeth 654 and the notches 656 to drive rotation of the circle frame 550 about the rotation axis RA.'

Figure 7:
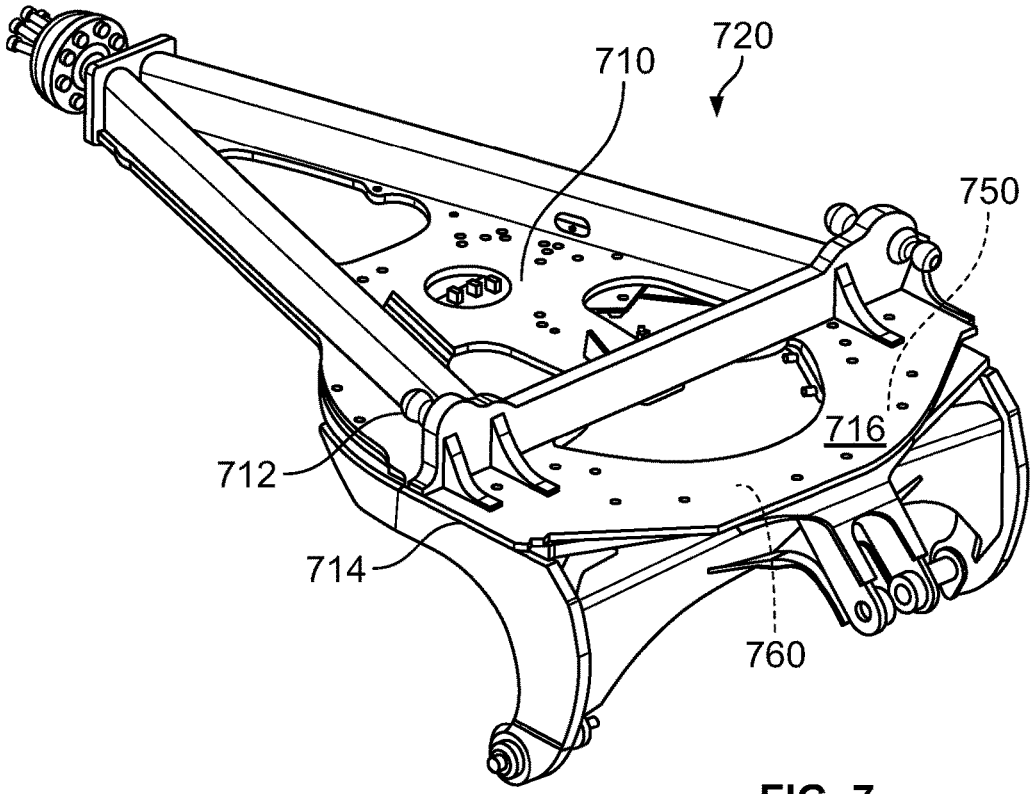
FIG. 7 is a perspective top view of yet another work implement assembly adapted for inclusion in the motor grader of FIG. 1.

Referring now to FIG. 7, an illustrative work implement assembly 720 includes a draft frame 710, a circle frame 750 pivotally coupled to the draft frame 710, and a mount kit 760 to pivotally retain the circle frame 750 to the draft frame 710. The draft frame 710 includes a platform 712 having a side 714 that faces a moldboard (not shown) supported by the circle frame 750 and a side 716 arranged opposite the side 714 that faces away from the moldboard. In the illustrative embodiment, the platform 712 substantially covers the mount kit 760 such that the mount kit 760 is substantially inaccessible from the side 716 of the draft frame 710.

Figure 8:
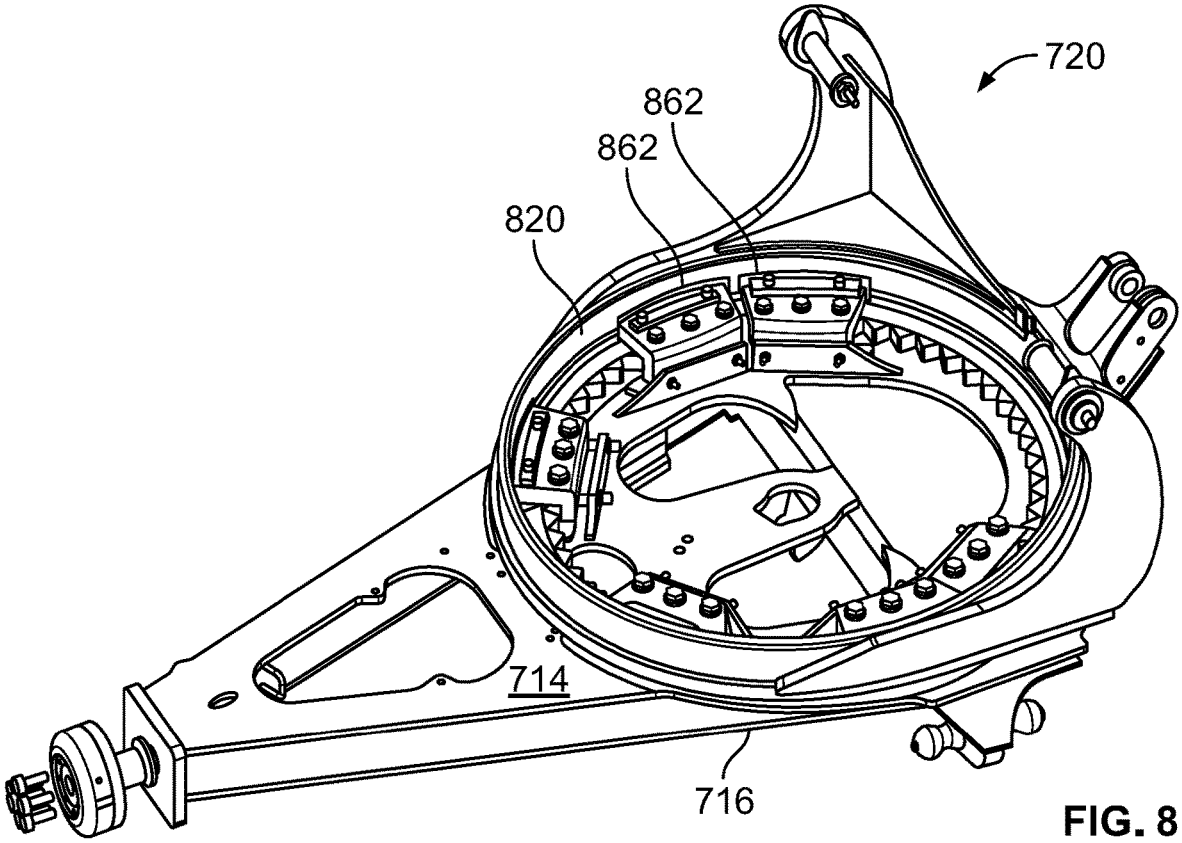
FIG. 8 is a perspective bottom view of the work implement assembly of FIG. 7.

Referring now to FIG. 8, the illustrative draft frame 710 includes a ring 820 that extends outwardly away from the side 714 of the platform 712 toward the moldboard. The ring 820 surrounds retainer assemblies 862 that are included in the mount kit 760 such that the retainer assemblies 862 are positioned inside the ring 820. In the illustrative embodiment, the retainer assemblies 862 are accessible for servicing and/or maintenance from the side 714 of the draft frame 710.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

The invention claimed is:

1. A grader comprising:

a chassis; and a work implement assembly including a draft frame pivotally coupled to the chassis, a circle frame coupled to the draft frame for rotation relative thereto to adjust an angular orientation of a moldboard supported by the circle frame, and a mount kit to pivotally retain the circle frame to the draft frame, wherein:

the draft frame includes a platform having a first side that faces the moldboard, a second side arranged opposite the first side that faces away from the moldboard, and an opening extending through the first and second sides, the circle frame is arranged in confronting relation to the first side of the platform and includes a circular wheel having teeth circumferentially arranged at an outer perimeter thereof, the mount kit includes a plurality of retainer assemblies at least partially positioned in the opening that are accessible from the second side of the platform, the work implement assembly includes a drive assembly to drive rotation of the circle frame relative to the draft frame, the drive assembly includes a drive unit and a disc coupled to the drive unit such that the drive unit drives rotation of the disc and the circle frame in use of the grader, the drive unit is mounted on the second side of the platform and the disc is mounted on the first side of the platform, and the disc is arranged in contact with the outer perimeter of the wheel such that the disc interacts with one or more of the teeth to drive rotation of the circle frame in use of the grader.

2. The grader of claim 1, wherein the draft frame includes a ring extending outwardly away from the second side of the platform and around the opening, and wherein each of the plurality of retainer assemblies is coupled to an inner surface of the ring for movement relative thereto along the inner surface during rotation of the circle frame relative to the draft frame.

3. The grader of claim 2, wherein each of the plurality of retainer assemblies includes a retainer case and a wear pad arranged between the retainer case and the inner surface of the ring to minimize direct contact between the inner surface and the retainer case during movement of the retainer case relative to the ring along the inner surface.

4. The grader of claim 3, wherein each of the plurality of retainer assemblies includes a bracket arranged in contact with the circle frame, a plurality of fasteners that each extend through the bracket and are arranged in contact with the retainer case, and a plurality of adjustment nuts that each receive a corresponding one of the plurality of fasteners, and wherein the plurality of adjustment nuts are movable along the plurality of fasteners to adjust the position of the retainer case relative to the inner surface of the ring and to facilitate access to the wear pad from the second side of the platform.

5. The grader of claim 1, wherein the draft frame includes a ring extending outwardly away from the second side of the platform and around the opening, wherein each of the plurality of retainer assemblies includes a retainer case that is coupled to an inner surface of the ring for movement relative thereto along the inner surface during rotation of the circle frame relative to the draft frame, and wherein each of the plurality of retainer assemblies includes a plurality of fasteners that extend through the retainer case and into the circle frame and are accessible from the second side of the platform.

6. The grader of claim 5, wherein the plurality of fasteners of each of the plurality of retainer assemblies includes three fasteners.

7. The grader of claim 6, wherein the plurality of retainer assemblies includes four retainer assemblies.

8. The grader of claim 1, wherein the draft frame includes a ring extending outwardly away from the second side of the platform and around the opening, wherein each of the plurality of retainer assemblies includes a retainer case that is arranged in contact with the circle frame and coupled to an inner surface of the ring for movement relative thereto along the inner surface during rotation of the circle frame relative to the draft frame, and wherein each of the plurality of retainer assemblies includes a first wear pad arranged between the retainer case and the second side of the platform to minimize direct contact between the retainer case and the draft frame during movement of the retainer case relative to the ring along the inner surface.

9. The grader of claim 8, wherein each of the plurality of retainer assemblies includes a second wear pad arranged between the first side of the platform and the circle frame to minimize direct contact between the draft frame and the circle frame during rotation of the circle frame relative to the draft frame.

10. The grader of claim 9, wherein the first wear pads of the plurality of retainer assemblies are accessible from the second side of the platform and the second wear pads of the plurality of retainer assemblies are accessible from an outer periphery of the draft frame and the circle frame.

11. A kit for a grader having a chassis, a draft frame coupled to the chassis, and a circle frame coupled to the draft frame for rotation relative thereto, the kit comprising:

a plurality of retainer assemblies each configured to be at least partially positioned in an opening that extends through a first side of a platform of the draft frame that faces a moldboard of the grader and is arranged in confronting relation to the circle frame and through a second side of the platform that is arranged opposite the first side and faces away from the moldboard, and a drive assembly to drive rotation of the circle frame relative to the draft frame that includes a drive unit, a disc coupled to the drive unit, and a circular wheel having teeth circumferentially arranged at an outer perimeter thereof that is coupled to the disc such that the drive unit drives rotation of the disc, the circular wheel, and the circle frame in use of the kit, wherein:

the plurality of retainer assemblies are configured to pivotally retain the circle frame to the draft frame in use of the kit, the plurality of retainer assemblies are accessible from the second side of the platform of the draft frame for maintenance and/or servicing when the circle frame is pivotally retained to the draft frame in use of the kit, the drive unit is mounted on the second side of the platform and the disc is mounted on the first side of the platform in use of the kit, and the disc is arranged in contact with the outer perimeter of the wheel such that the disc interacts with one or more of the teeth to drive rotation of the circle frame in use of the kit.

12. The kit of claim 11, wherein each of the plurality of retainer assemblies includes a retainer case having a first block configured for interaction with the second side of the platform of the draft frame and a second block interconnected with the first block that is configured for direct interaction with the circle frame, and wherein the first block and the second block of each retainer case are accessible from the second side of the platform of the draft frame in use of the kit.

13. The kit of claim 12, wherein the second block of the retainer case of each of the plurality of retainer assemblies includes a plurality of columns and a plurality of cutouts each positioned between adjacent columns of the plurality of columns.

14. The kit of claim 13, wherein the plurality of columns of the second block of each retainer case include three columns, and wherein the plurality of cutouts of the second block of each retainer case include two cutouts.

15. The kit of claim 13, wherein each of the plurality of cutouts of the second block of each retainer case is cooperatively defined at least in part by a first exterior surface of a first column, a second exterior surface of a second column that faces the first exterior surface of the first column, a rib exterior surface of a rib of the second block that interconnects the first and second exterior surfaces, and a base of the second block that is interconnected with the first column, the second column, and the rib.

16. The kit of claim 15, wherein the base of the second block of each retainer case is configured to contact the circle frame in use of the kit, wherein the plurality of columns of the second block of each retainer case extend outwardly away from the corresponding base over a first distance, and wherein an outer surface of the first block of each retainer case is spaced a second distance greater than the first distance from the corresponding base.

17. The kit of claim 13, further comprising a plurality of fasteners each sized to be received by a corresponding one of the plurality of columns of the second block of each retainer case such that each fastener extends all the way through the corresponding column and into the circle frame in use of the kit.

18. A method of servicing a grader including a chassis, a draft frame coupled to the chassis, a circle frame coupled to the draft frame for rotation relative thereto, and a mount kit to pivotally retain the circle frame to the draft frame, the method comprising:

accessing, from one side of a platform of the draft frame that faces away from a moldboard of the grader, a plurality of retainer assemblies of the mount kit that are at least partially positioned in an opening of the platform that extends through the one side of the platform and through another side of the platform arranged opposite the one side;

accessing, from the one side of the platform, a drive unit of a drive assembly that drives rotation of the circle frame relative to the draft frame in use of the grader and is mounted on the one side of the platform, accessing, from the another side of the platform, a disc mounted on the another side of the platform that is driven by the drive unit to cause rotation of the circle frame in use of the grader, and at least partially disassembling one or more of the plurality of retainer assemblies, wherein accessing the disc mounted on the another side of the platform includes accessing a circular wheel having teeth circumferentially arranged at an outer perimeter thereof that is arranged in contact with the disc at the outer perimeter.

19. The method of claim 18, wherein at least partially disassembling one or more of the plurality of retainer assemblies includes adjusting a position of a retainer case of at least one of the plurality of retainer assemblies relative to a ring extending outwardly away from the one side of the platform to access a first wear pad arranged between the retainer case and the ring.

20. The method of claim 19, wherein at least partially disassembling one or more of the plurality of retainer assemblies includes accessing a second wear pad arranged between the retainer case of the at least one of the plurality of retainer assemblies and the draft frame and a third wear pad arranged between the second side of the platform and the circle frame.

* * * * *